US006856865B2

(12) United States Patent
Hawthorne

(10) Patent No.: US 6,856,865 B2
(45) Date of Patent: Feb. 15, 2005

(54) METHOD AND APPARATUS OF MONITORING A RAILROAD HUMP YARD

(75) Inventor: Michael J. Hawthorne, Arlington, TX (US)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 10/751,945

(22) Filed: Jan. 7, 2004

(65) Prior Publication Data

US 2004/0138789 A1 Jul. 15, 2004

Related U.S. Application Data

(62) Division of application No. 10/301,729, filed on Nov. 22, 2002.

(51) Int. Cl.[7] ..... G06F 7/00
(52) U.S. Cl. ..... 701/19; 246/187 A
(58) Field of Search ..... 701/19, 20, 1, 701/212, 213; 246/187 A

(56) References Cited

U.S. PATENT DOCUMENTS

| | | | | |
|---|---|---|---|---|
| 3,689,788 A | | 9/1972 | Wong et al. | |
| 3,844,514 A | | 10/1974 | DiPaola et al. | |
| 4,610,206 A | | 9/1986 | Kubala et al. | |
| 5,676,337 A | | 10/1997 | Giras et al. | |
| 5,758,848 A | | 6/1998 | Beule | |
| 5,883,337 A | | 3/1999 | Dolan et al. | |
| 5,886,663 A | | 3/1999 | Broxon, II et al. | |
| 6,135,396 A | | 10/2000 | Whitfield et al. | |
| 6,144,901 A | | 11/2000 | Nickles et al. | |
| 6,246,956 B1 | | 6/2001 | Miyoshi et al. | |
| 6,263,266 B1 | * | 7/2001 | Hawthorne | 701/19 |
| 6,377,877 B1 | | 4/2002 | Doner | |
| 6,480,766 B2 | * | 11/2002 | Hawthorne et al. | 701/19 |
| 6,658,331 B2 | * | 12/2003 | Horst et al. | 701/19 |
| 6,691,005 B2 | * | 2/2004 | Proulx | 701/19 |
| 2003/0144772 A1 | * | 7/2003 | Proulx | 701/19 |
| 2003/0236654 A1 | * | 12/2003 | Flynn et al. | 703/8 |
| 2004/0064223 A1 | * | 4/2004 | Horst et al. | 701/19 |

* cited by examiner

*Primary Examiner*—Gertrude A. Jeanglaude
(74) *Attorney, Agent, or Firm*—Barnes & Thornburg LLP

(57) ABSTRACT

A method of monitoring a railroad hump yard, including storing a profile of the hump yard. The commands sent to one or more of the retarding devices and track switches are determined. The telemetry of a car at at least one point after release over the hump is obtained. Finally, the telemetry of the car for the remainder of the path in the hump yard is calculated. The calculated telemetry of the car over the path in the hump yard may be displayed real time or may be stored and subsequently displayed. A remote control locomotive device includes operator input, a display, a data base of at least a track profile and a program to drive the display with the location of the train on the track profile.

8 Claims, 2 Drawing Sheets

METHOD AND APPARATUS OF MONITORING A RAILROAD HUMP YARD

CROSS-REFERENCE

This is a Divisional of U.S. patent application Ser. No. 10/301,729 filed on Nov. 22, 2002.

BACKGROUND AND SUMMARY OF THE INVENTION

The present invention relates generally to railroad hump yards and, more specifically, to the monitoring and management of a railroad hump yard.

Railroads use hump yards to marshal trains. The hump yard basically provides a switch point where a car can be attached to one of many trains. A string of cars is pushed up an incline by a switcher locomotive. When the car reaches the crest of the incline or hump, the car is released from the string and rolls down the hump to pick up speed. Part way down the hill or hump, the car will encounter a retarding device that will slow the car to the proper speed. The ideal speed represents just enough energy to cause the couplers of the mating cars to engage, but no more. The car will also encounter a series of switches to direct the car to the appropriate train. Any excess speed or energy as the car couples to the train will be transferred to the car and lading. The retarding devices and the switches are generally controlled remotely from a hump yard tower.

Also, in the hump or other yards, the locomotive may be controlled from a remote location by an operator on the ground. The remote control locomotive (RCL) systems usually include an RCL device carried by the operator. In the industry, these are known as "belt packs." The location of the RCL operator is important to the management of the yard, as well as the control signals that are sent to the locomotive. From the ground perspective, the RCL operator does not always have an appropriate perspective of the total layout of the yard, much less the total train. Also, since he is not on the train, he cannot sense the forces in the train by the seat of his pants, as most well-trained over the road operators can.

The present invention is a method of monitoring a railroad hump yard, including storing a profile of the hump yard. The commands sent to one or more of the retarding devices and track switches are determined. The telemetry of a car at at least one point after release over the hump is obtained. Finally, the telemetry of the car for the remainder of the path in the hump yard is calculated. The telemetry includes one or more of images, speed, acceleration and location of the car. The telemetry may be obtained from one or more of the car, a locomotive, an RCL device and track side sensors. The calculated telemetry of the car over the path in the hump yard may be displayed real time or may be stored and subsequently displayed.

If stored and subsequently displayed in a playback mode, one or more of the commands can be modified and the telemetry of the car for the remainder of the path recalculated. These results may be displayed. Also, instead of changing the commands, the telemetry of the car may be changed in the playback mode and the resulting telemetry recalculated and displayed. Also, in the playback mode, the telemetry of the locomotive which pushes the car over the hump to produce the modified telemetry of the car may be determined.

The present method may be performed at one or more of a control station at the hump yard, on an RCL device, or on the locomotive pushing the car at the hump. The calculated telemetry of the car may also be compared against a predetermined telemetry, and a variance report may be produced.

For complete monitoring of the railroad yard, the location of an RCL device is obtained. The location of the RCL device is correlated and stored with the calculated telemetry of the car. This stored information may also be time-stamped. The time-stamped, stored data may also be correlated with time-stamped video of the yard. This provides a complete correlated database for management and analysis of, for example, accidents.

A software capable of being modified to perform this method is available in the LEADER product available from New York Air Brake Corporation.

An improved portable RCL device capable of use in this invention and others includes an operator input for generating locomotive commands and a transceiver for transmitting locomotive commands to a locomotive. It also includes a display and a data base of at least a track profile. A program on the device determines and drives the display to show the location of the locomotive on the track. The program also determines and drives the display to show the location and forces in the train, including the locomotive. The transceiver receives and provides locomotive telemetry to the program. The telemetry of the locomotive includes global positioning data. The device may also include a global positioning system (GPS) communicating with the program. When the transceiver receives and provides locomotive telemetry from other transmitters to the program, the program drives the display to show the location of other transmitters. The information received and determined by the portable RCL device is stored thereon for playback on the device or for transmission to a central base to be used in playback or for analysis.

These and other aspects of the present invention will become apparent from the following detailed description of the invention, when considered in conjunction with accompanying drawings.

DETAILED DESCRIPTION OF THE PREFERRED EMBODIMENTS

Figure 1:
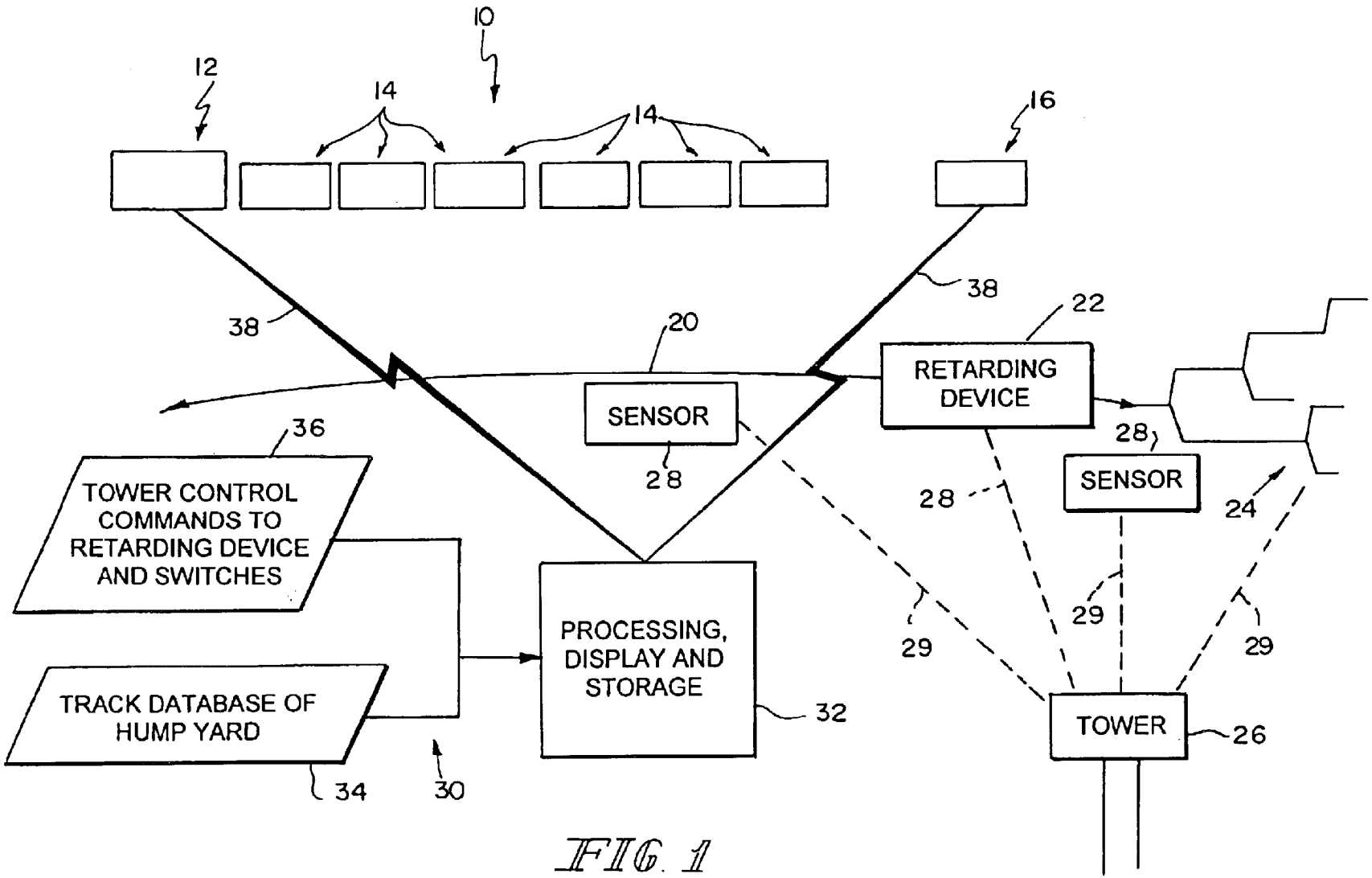
FIG. 1 is a schematic view of a hump yard, including the management system incorporating the principles of the present invention.

With the proper radio communication and sensor capabilities, LEADER technology, as shown in U.S. Pat. No. 6,144,901 and available from New York Air Brake Corporation, can be applied to a railroad hump or other yards and centralized in the control tower. The telemetry (speed, acceleration, location, etc.) of the car can be determined by the locomotive pushing the car, a sensor set on the car itself, and/or a GPS device located on the car. The telemetry of the car can be sent to a Display/Processor in the control tower of the hump yard. The Display/Processor will have the track profile of the hump yard and inputs from the control tower to determine the command sent to the switches and retarding device. The same basic LEADER algorithms will be used to perform dynamic calculations and both display and record the data collected. The same type of LEADER exception or variance reporting is described, for example, in U.S. patent application Ser. No. 10/247,370, filed Sep. 20, 2002 and available from New York Air Brake Corporation, wherein a standard freight application can be used to identify dynamic events that are of interest to the railroads. The benefits offered by a standard LEADER System will be offered by a Tower LEADER System.

The advantage of using LEADER technology in this application is the ability to gain an understanding of the events that may have led to a dynamic event. Onboard car technology can detect the event occurred, where it occurred, and the magnitude of the event, but may not be able to pinpoint the cause. LEADER processing will quickly identify the cause and provide the ability to model the operation via simulation to make operational changes to prevent the problem from recurring.

The LEADER concept of data capture, recording and reporting can be extended to include use of an RCL device in a switching yard of the railroad. Rather than using the input controls of a locomotive as a data source, the LEADER models can use the input of an RCL device. With sufficient information about the cars being switched, LEADER could offer a display to the RCL operator similar to that offered to the locomotive engineer over the road. A map of the switch yard would be displayed with a live representation of other vehicles in the vicinity and their movements.

A GPS-type system can be incorporated into the RCL or the switch yard event recorder to locate the operator (or at least the RCL) for accurate location on the switch yard. The same GPS can be used to provide a common time-stamp for other recording devices, such as video cameras, monitoring the yard.

The system could act as an event recorder by collecting data at the RCL device and storing it within the unit or, more practically, by centrally locating a radio receiver unit which would receive signals from all RCL devices in use and recording each data in a separate file for later review. Data storage at the RCL unit can be thought of as distributed throughout the yard, while the single data capture and storage device can be thought of as centralized.

Either centralized or distributed data storage processes can be supplemented by other data sources, such as time-stamped video recording of the switch yard. All collected data can be correlated by the time-stamp and reviewed in the event of an accident or for a regular performance review.

A train 10 having a locomotive 12 and a plurality of cars 14 connected thereto is illustrated in FIG. 1. A car 16, which has been released from the marshaled cars 14, is illustrated also. These are shown above a hump track profile 20, which includes a retarding device 22 and a switching network 24. A tower 26 monitors and controls the retarding device 22 and the switching network 24 via communication links 29. Sensors 28, including but limited to cameras, may also be positioned along the hump track path and also connected to the tower 26 via communication links 29. These may be hard wired or radio. As previously described, the general operation of the hump yard is well known, with the locomotive positioning the cars at the crest of the hump and releasing the cars to roll down the hump path through retarding device 22 and switching network 24 to be assembled on different trains. The ultimate goal is to have the car 16 arrive with just enough force to close the coupling, though not creating excessive force in the remainder of the trains to which it is to be a part of.

Figure 2:
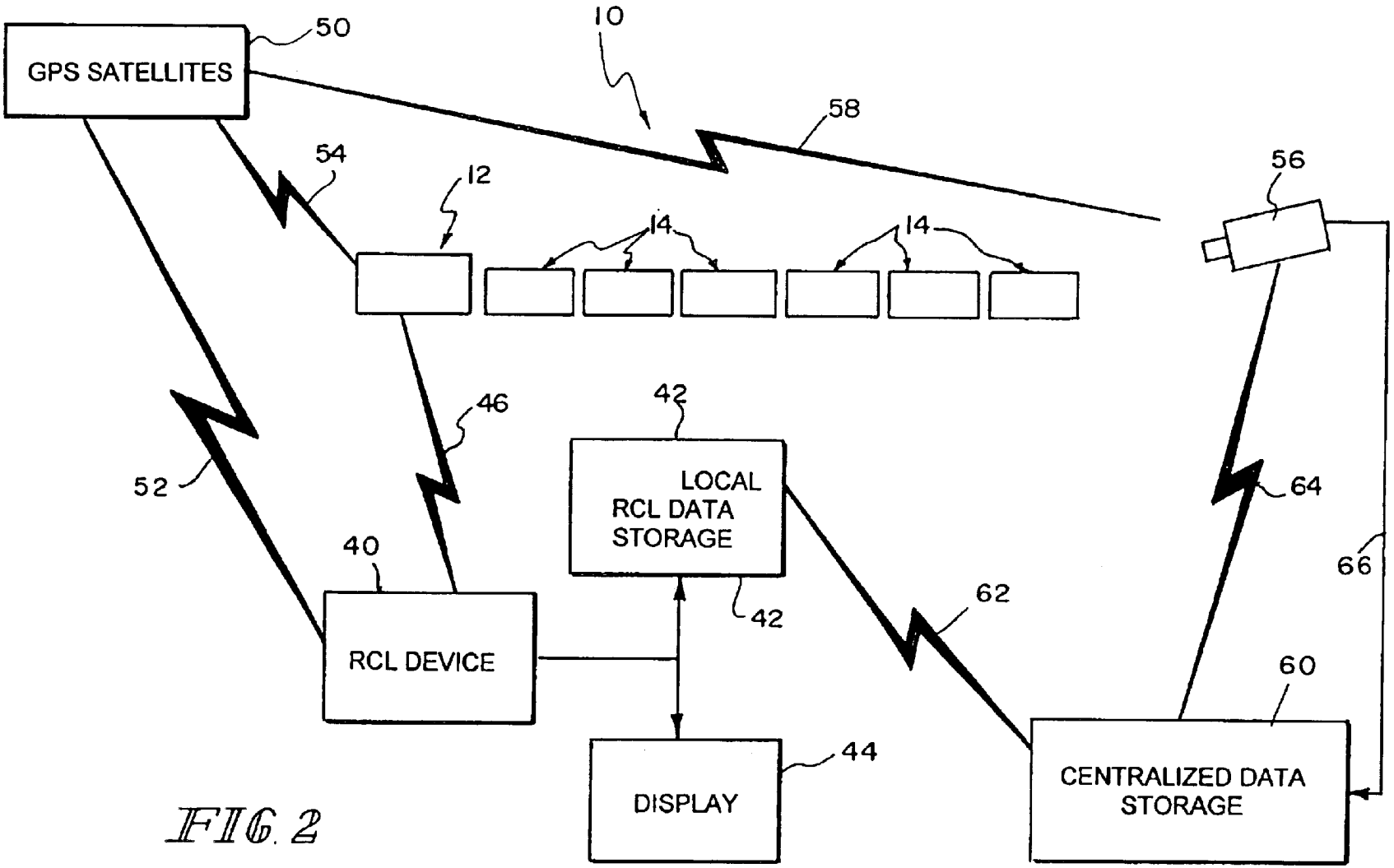
FIG. 2 is a schematic view of a hump yard, including an RCL device incorporating the principles of the present invention.

The ability to monitor, control and analyze the railroad hump yard is increased by the monitoring system 30 of FIG. 1. A centralized processing, display and storage unit 32 is provided. It includes, for example, processing display and storage control software of the LEADER system, which is described in U.S. Pat. No. 6,144,901 and available from New York Air Brake Corporation. Provided at 32 is a track data base of the hump yard. This is a profile, as well as the characteristics of the track profile. Additional information used by the software 32 includes the tower control commands to the retarding device 22 and the switch network 24. This is input 36. The telemetry of the car 16 from at least one point along the path 20 in the hump yard is obtained by unit 32. This may be from the individual car 16 itself, the locomotive 12 or from the sensors 28 adjacent to the hump track. The telemetry may include images, speed, acceleration and location. The location of the locomotive 12 may be determined by a GPS on the car in cooperation with a satellite, as illustrated in FIG. 2. The telemetry of the car 16 can be obtained from the car 16, the locomotive 12 pushing the car 16, or track side sensors 28. The telemetry can be calculated on the car 16, on the locomotive 12 or at the central unit 32. The central unit 32 communicates with the locomotive 12 and the car 16 via radio links 38.

The unit 32 uses the stored data base 32 of the hump yard, the commands to the retarding device 22 and switch network 24, and the telemetry of the car 16 at at least one point to calculate the telemetry of the car for the remainder of the path in the hump yard. The location of the car on the hump track profile 20 can be displayed and projected or played forward into time throughout the path in the hump yard. This will allow the operator to vary the retarding device 22 and the switching device 24 as the car moves. If the car 16 includes any remote electronic or radio-controlled brakes, these can also be applied by the communication from unit 32. The telemetry of the car 16 in combination with the tower control commands may be stored for later playback and analysis. The monitoring system 30 may be at the tower 26, in the locomotive 12 or in a portable device, for example, an RCL device, as illustrated in FIG. 2.

The monitoring system 30 has the ability to adjust the retarding device based on LEADER system's tuning of efficiencies from knowledge of car telemetry. This would provide data for adjusting the retarding device 22 based on current comparison of expected speed vs. actual speed. The tuning algorithm zeros-in on the retarding device's efficiency and allow for direct actuation or recommended or actual control of the retarding device 22. This would allow for adjustment of car speed for optimal coupling.

In a playback mode, the unit 32 will allow the train control commands to the retarding device 22 and the switching device 24 to be changed, and the telemetry of the car 16 is recalculated. This illustrates the effects of changing the commands. Also, the initial telemetry of the car 16 may be varied with a recalculation of the resulting telemetry. A combination of a change in the car's initial telemetry and the tower commands can also be performed in a playback mode. This allows analysis of the operation of the yard. Also, the telemetry required by the locomotive 12 to produce the changed telemetry of the car 16 can also be calculated by the unit 32.

A rail yard includes more than just the hump yard portion. As illustrated in FIG. 2, a yard may include the train 10 with locomotive 12 and cars 14, wherein the locomotive 12 is controlled by RCL device 40. The RCL device 40 may include substantially more information and intelligence to be displayed to the operator. It would include a local RCL data storage and program 42 and a display 44. The RCL device 40 has a transceiver to communicate with locomotive 12 via air waves 46. The location of the train on the track within the yard would be determined by the programming storage device 42 and displayed on display 44. This would give the operator a different view point of the locomotive within the yard, which would not be available from his perspective. This is especially true since the operator of the RCL device is generally at ground level. The locomotive 12 generally has a GPS device receiving signals from a satellite 50 via link 54. This information can be conveyed to the RCL device 40 to aid in locating the device's current position in the pre-stored data base for the track or yard at 42. The RCL device may also include a GPS transponder receiving signal by 52 from the satellite 50. This will determine its position within the yard. The device 42 would include software equivalent to that of the LEADER technology. This will allow the system 42 to drive the display 44 to show not only the location of the train 10 on the track or within the yard, but also allow display of forces throughout the train 10. This is important in the control and operation of the train 10 within the yard.

Also, within the yard, are generally cameras 56, which may include a GPS device communication with the GPS satellite 50 via radio link 58. The cameras 56 may also be connected with a centralized data storage 60 via radio link 64 or by hard wire 66. The transceiver of the RCL device 40 also can communicate with the centralized data storage 60 via radio link 62. The centralized data storage 60 correlates the telemetry of the train 10 with the commands from the RCL device 40 for further use. It also may be correlated with the video from the camera 56. This is achieved through time-stamp of the information from the locomotive 12 and the RCL device 40. This is correlated with the time-stamped information from the camera 56. By using the time stamp received from the GPS satellite 50, the accuracy and ease of correlation of information from the locomotive 12, RCL device 40 and camera 56 is increased.

The centralized data storage 60 may collect information from other locomotives and RCL device 40 within the yard. This information may also be transmitted from the locomotive and RCL devices to other RCL devices for displaying of their positions in the yard on the display 44 of the RCL device 40. That would allow an operator to know where other operators are in the work environment. Also, a tag may be worn by yard workers that would also transmit its position. That would allow locomotive operators (RCL or onboard) to know where other workers wearing tags are located and add a measure of safety. The software would include the ability to avoid co-occupation of any workspace by a locomotive and an RCL device (collision avoidance based on telemetry calculations).

The centralized data storage 60 allows playback of the information for management control and accident analysis of the yard. As in other LEADER systems, in playback, a simulation can take place by varying the telemetry of the train to see what results would occur. The software 42 has the ability of performing playback locally. The centralized data storage 60 may be at any remote location, for example, the tower 26 from FIG. 1.

The RCL device 40 of FIG. 2 may be used in the hump yard of FIG. 1 or in any yard control.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed:

1. A portable remote control locomotive device comprising:

an operator input for generating locomotive commands;

a transceiver for transmitting the locomotive commands to a locomotive;

a display;

a data base of at least a track profile stored on the device; and a program on the device for determining and driving the display to show the location of the locomotive on the track.

2. The device according to claim 1, wherein the program determines and drives the display to show the location and the forces in a train including the locomotive.

3. The device according to claim 1, wherein the transceiver receives and provides locomotive telemetry to the program.

4. The device according to claim 3, wherein the telemetry includes global positioning data.

5. The device according to claim 4, including a global positioning system communicating with the program.

6. The device according to claim 3, wherein the transceiver receives and provides locomotive telemetry from other transmitters to the program, and the program drives the display to show the locations of the other transmitters.

7. The device according to claim 3, wherein the program stores the location and other information of the locomotive for later playback.

8. The device according to claim 7, wherein the transceiver transmits the stored locomotive location and information to a central base.

* * * * *